US007466286B2

(12) United States Patent
Chapman

(10) Patent No.: US 7,466,286 B2
(45) Date of Patent: Dec. 16, 2008

(54) FOLDING FRAME FOR MOUNTING AN ANTENNA

(76) Inventor: Brandon M. Chapman, 407 S. Harris St., Bourbon, IN (US) 46504

( * ) Notice: Subject to any disclaimer, the term of this patent is extended or adjusted under 35 U.S.C. 154(b) by 451 days.

(21) Appl. No.: 11/368,857

(22) Filed: Mar. 6, 2006

(65) Prior Publication Data

US 2007/0205957 A1 Sep. 6, 2007

(51) Int. Cl.

| | |
|---|---|
| ***H01Q 3/24*** | (2006.01) |
| ***H01Q 1/12*** | (2006.01) |
| ***H01Q 9/34*** | (2006.01) |
| ***E04H 14/00*** | (2006.01) |
| ***E04H 12/18*** | (2006.01) |

(52) U.S. Cl. ..... 343/890; 343/891; 343/892; 343/880; 343/881; 343/882; 343/874; 343/875; 343/879; 52/645; 52/79.5

(58) Field of Classification Search ..... 343/890, 343/891, 892, 880, 881, 882, 879, 874, 875, 343/871; 52/645, 79.5

See application file for complete search history.

(56) References Cited

U.S. PATENT DOCUMENTS

| | | | | |
|---|---|---|---|---|
| 2,630,531 | A * | 3/1953 | Finneburgh, Jr. | 343/801 |
| 2,897,495 | A * | 7/1959 | Carthay | 343/803 |
| 3,665,477 | A * | 5/1972 | Budrow et al. | 343/714 |
| 4,145,696 | A * | 3/1979 | Gueguen | 343/792.5 |
| 5,533,304 | A * | 7/1996 | Noble | 52/40 |
| 5,920,291 | A | 7/1999 | Bosley | 343/892 |
| 5,971,345 | A * | 10/1999 | Khalaf | 248/512 |
| 6,321,501 | B1 * | 11/2001 | Ignash | 52/645 |
| 7,086,207 | B2 | 8/2006 | Piburn et al. | |
| 7,113,145 | B1 * | 9/2006 | Noble | 343/892 |
| 7,357,238 | B2 * | 4/2008 | Zeigler | 193/35 TE |
| 2008/0115816 | A1 * | 5/2008 | Miller | 135/126 |

OTHER PUBLICATIONS

Hutton Communications, Inc., "Andrew Quik-Tee Sector Frames", undated (1 page).
Andrew Corporation, "New QT-SF quik-tee, sector frame", pp. 6-7, undated (2 pages).

* cited by examiner

*Primary Examiner*—Douglas W. Owens
*Assistant Examiner*—Jennifer F Chang
(74) *Attorney, Agent, or Firm*—Thomte Patent Law Office; Dennis L. Thomte

(57) ABSTRACT

A folding frame for mounting an antenna on an upstanding support structure including first and second support arms pivotally secured to an upper mounting bracket and third and fourth support arms which are pivotally secured to a lower mounting bracket with the upper and lower mounting brackets being secured to the support structure. Support members are pivotally secured to the outer ends of the support arms and are pivotally connected together so that the frame may be pivotally moved from a folded position to a non-folding position. When the frame is in its folded position, it is easily shipped on a pallet.

20 Claims, 5 Drawing Sheets

FOLDING FRAME FOR MOUNTING AN ANTENNA

BACKGROUND OF THE INVENTION

1. Field of the Invention

This invention relates to a folding frame for mounting an antenna and more particularly to a folding frame for mounting an antenna on an upstanding support structure such as a tower, pole or the like.

2. Description of the Related Art

Wireless communication antennas are commonly mounted on upstanding support structures such as towers, poles, etc., to optimize signal reception and transmission. The antennas may be secured to the support structures by a variety of different mounting assemblies or mounts. Some of the mounts are commonly referred to as a T-frame mount, a V-frame mount, standoff sector mount, etc. The prior art mounting assemblies or mounts may be partially assembled at the factory and shipped to the job site on a pallet or the like or may be shipped to the job site in an unassembled manner. If the mounting assembly is partially or completely assembled at the factory, the assembled size thereof creates shipping problems. If the mounting assemblies are shipped to the job site in an unassembled condition, the components thereof must be assembled at the job site which is time-consuming.

Recently, Andrew Corporation of Orland Park, Ill., has been distributing a folding frame for mounting an antenna identified as a "Quik-Tee Sector Frame" which may be assembled at the factory, folded and shipped to the job site on a pallet. Although the Andrew Corporation Quik-Tee Sector Frame, after being assembled, may be folded to reduce its shipping size, applicant believes that the Andrew Corporation structure, in its folded position, is still too large for convenient shipping and that the Andrew Corporation structure, in its non-folded position, may not be as structurally sound as is desirable. Its flat member design produces greater wind loading on the existing structure. The commonly used single support arm design is prone to twist causing permanent deformation and possible failure when a man load is applied at the ends of each face.

SUMMARY OF THE INVENTION

A folding frame for mounting an antenna on an upstanding support structure such as a tower, pole, etc., which includes upper and lower mounting brackets which are attached to the support structure. First, second, third and fourth elongated support arms are provided with each of the arms having inner and outer ends. The inner ends of the first and second support arms are pivotally secured to the upper mounting bracket about a generally vertical axis and extend outwardly therefrom. The inner ends of the third and fourth support arms are pivotally secured to the lower mounting bracket about a generally vertical axis and extend outwardly therefrom. First, second, third and fourth elongated support members are also provided, each of which have first and second ends. The first support member is pivotally secured, intermediate its length, to the outer end of the first support arm about a generally vertical axis so that the first support member is generally horizontally disposed. The second support member is pivotally secured, intermediate its length, to the outer end of the second support arm about a generally vertical axis so that the second support member is generally horizontally disposed. The third support member is selectively pivotally secured, intermediate its length, to the outer end of the third support arm about a generally vertical axis so that the third support member is generally horizontally disposed. The fourth support member is selectively pivotally secured, intermediate its length, to the outer end of the fourth support arm about a generally vertical axis so that the fourth support member is generally horizontally disposed.

The second ends of the first and second support members are selectively pivotally secured together about a generally vertical axis so that the first and second support members may be selectively moved between a first folded position to a second extended or non-folded position. The second ends of the third and fourth support members are selectively pivotally secured together about a generally vertical axis so that the third and fourth support members may be selectively moved between a first folded position to a second extended or non-folded position. One or more upstanding antenna supports are secured to and extend between the first and third support members and one or more upstanding antenna supports are secured to and extend between the second and fourth support members.

When the support members are in their folded position between the support arms, the frame occupies a relatively small amount of space so that it may be easily shipped to the job site on a pallet. Once at the job site, the folded structure may be unfolded to as to be placed in its operative position. The frame is then secured to the support structure and the antennas, if not already secured to the antenna supports, are secured to the antenna supports.

It is therefore a principal object of the invention to provide a folding frame for mounting an antenna on an upstanding support structure.

A further object of the invention is to provide a folding frame for mounting an antenna on an upstanding support wherein the frame may be folded for shipment.

A further object of the invention is to provide a folding frame which may be easily moved from its folded position to its unfolded or extended position so that the folding frame may be secured to an upstanding support structure such as a tower, pole, etc.

Still another object of the invention is to provide a folding frame for mounting an antenna on an upstanding support structure which, in its installed position, is extremely durable in use and refined in appearance.

These and other objects will be apparent to those skilled in the art.

DETAILED DESCRIPTION OF THE INVENTION

Figure 1:
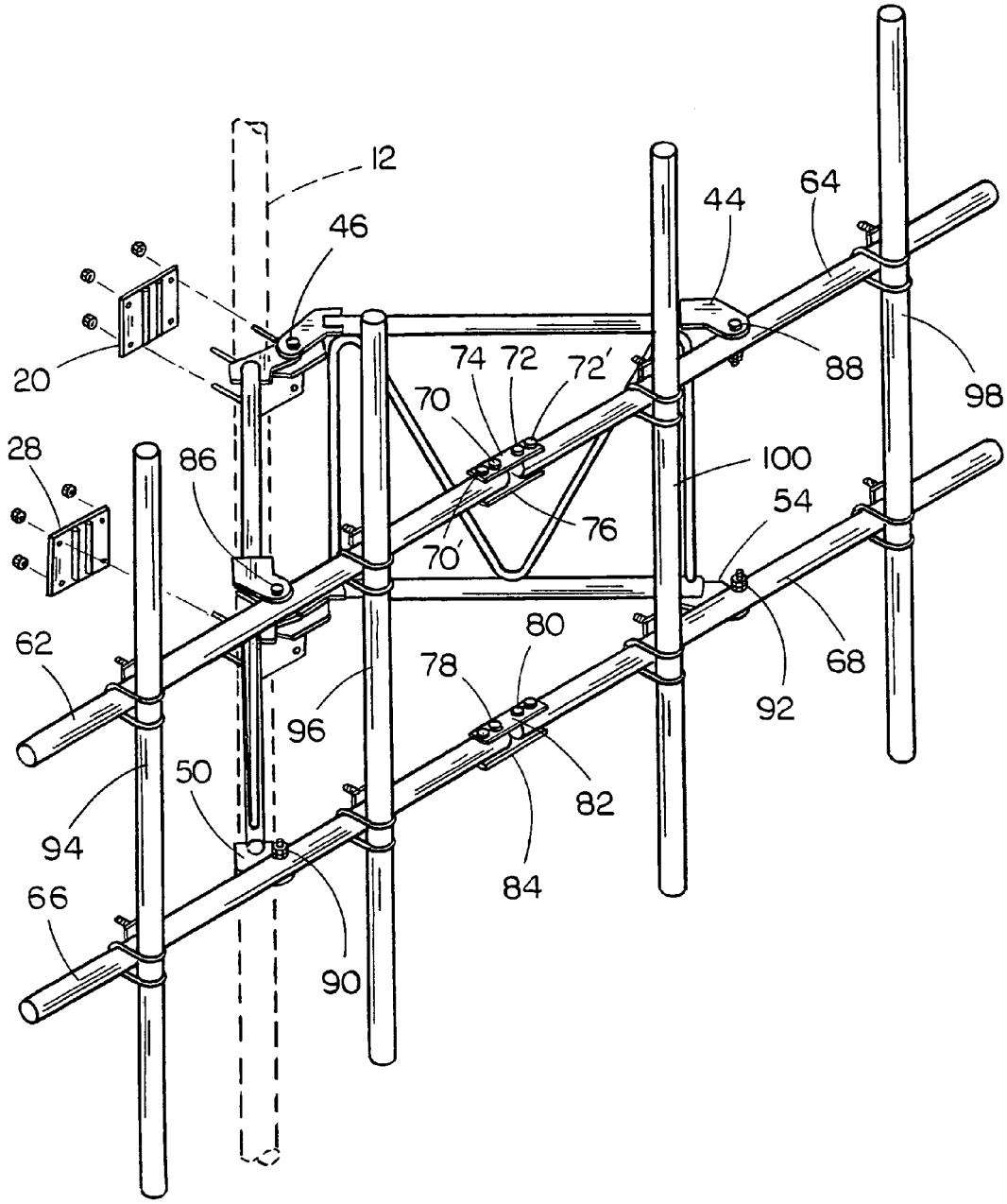
FIG. 1 is a perspective view of the folding frame of this invention in its operative position and which is shown to be attached to a support structure and which illustrates the antenna support mounted thereon.

The folding frame of this invention which is used for mounting an antenna on an upstanding support structure is referred generally by the reference numeral 10. The frame 10 is adapted to be mounted on a vertically disposed support member, structural member or leg such as found in a tower, pole, structural member, etc., as identified by the reference numeral 12. Normally, the support structure 12 will be substantially vertically disposed but may be inclined with respect to vertical or may be tapered.

The numeral 14 refers to an upper mounting bracket which is adapted to be secured to the support structure 12. Bracket 14 includes a base portion 16 having a top portion 18 extending outwardly therefrom. Base portion 16 is positioned at the outer side of the support structure and a clamp plate 20 is positioned at the inner side of the support structure so that bolts may be extended through the base portion 16 and the clamp plate 20 to secure the upper bracket 14 to the support structure.

The numeral 22 refers to a lower mounting bracket including a base portion 24 and a top portion 26. Base portion 24 is positioned at the outer side of the support structure and a clamp plate 28 is positioned at the inner side of the support structure so that bolts may be extended through the base portion 24 and the clamp plate 28 to secure the lower mounting bracket 22 to the support structure 12 below the upper bracket 14.

The numerals 30, 32, 34 and 36 refer to elongated support arms. Preferably, the support arms 30, 32, 34 and 36 are in the form of round or cylindrical pipes to provide a low wind-load standard. An angled plate 38 is secured to the inner end of support arm 30 while angled plate 40 is secured to the outer end of support arm 30. Plate 38 is sometimes referred to as a mounting plate while plate 40 is sometimes referred to as a pivot plate. An angled plate 42 is secured to the inner end of support arm 32 and an angled plate 44 is secured to the outer end of support arm 32. The angled plates 38 and 42 are pivotally secured to top portion 18 of upper bracket 14 by bolt 46.

Angled plate 48 is secured to the inner end of support arm 34 while angled plate 50 is secured to the outer end of support arm 34. Angled plate 52 is secured to the inner end of support arm 36 while an angled plate 54 is secured to the outer end of support arm 36. Angled plates 48 and 52 of support arms 34 and 36 are pivotally secured to the top portion 26 of lower mounting bracket 22 by bolt 56. Preferably, a brace 58 is secured to and extends between support arms 30 and 34, as seen in the drawings, and a brace 60 is secured to and extends between support arms 32 and 36.

Figure 3:
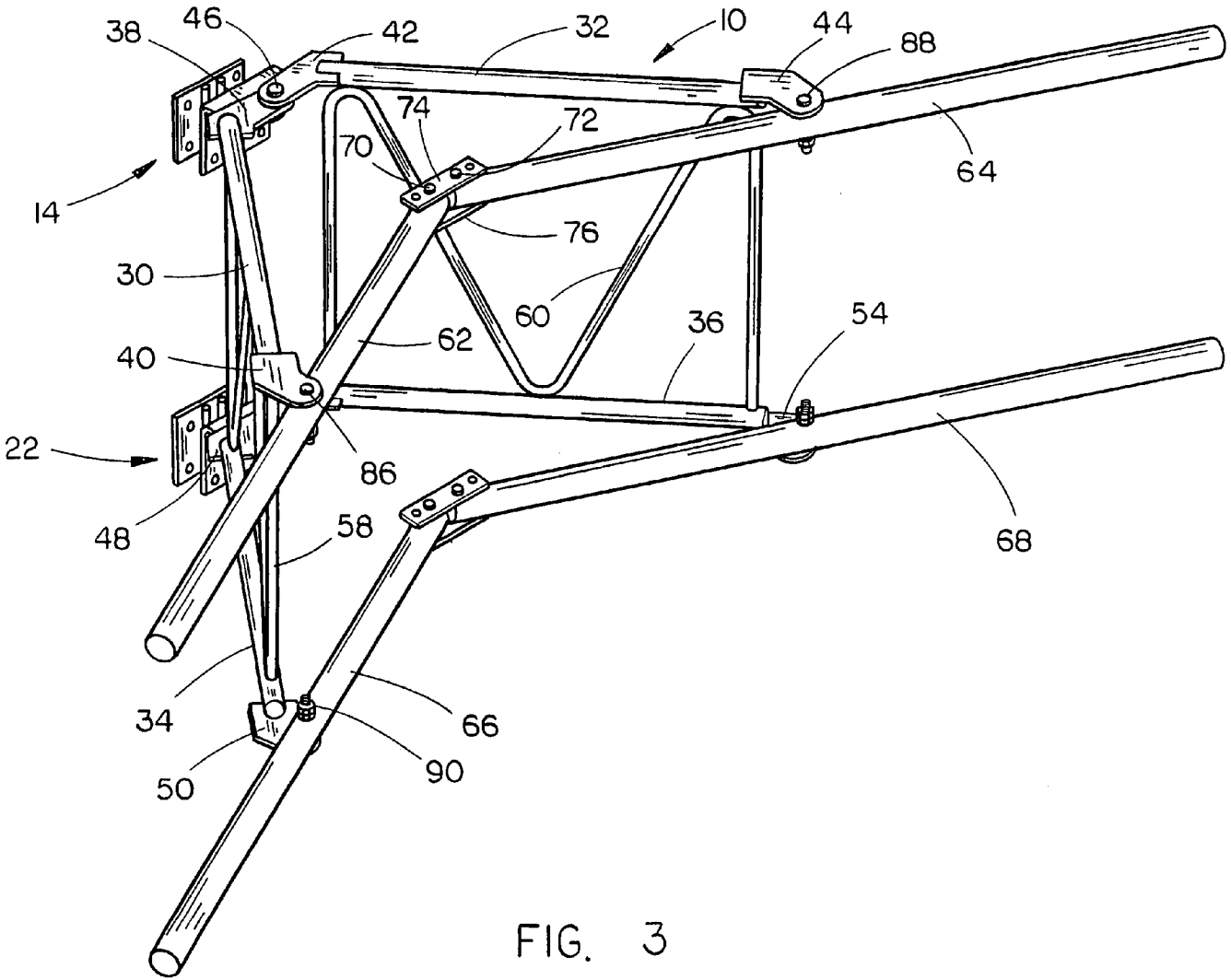
FIG. 3 is a perspective view of illustrating the folding frame being pivotally moved from its folded position towards its extended or operative position.
Figure 4:
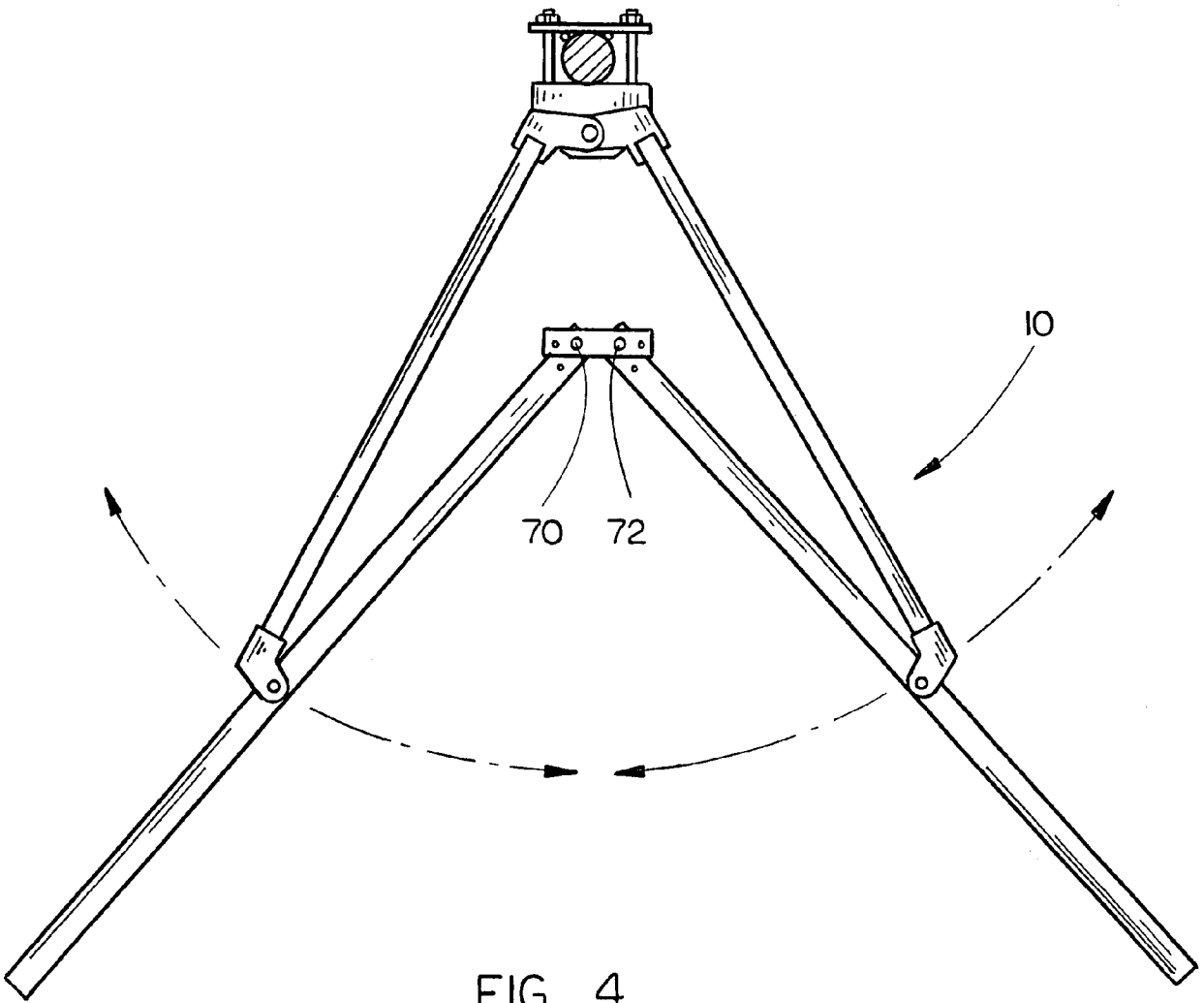
FIG. 4 is a top view illustrating the manner in which the folding frame may be moved between its folded and unfolded positions.
Figure 5:
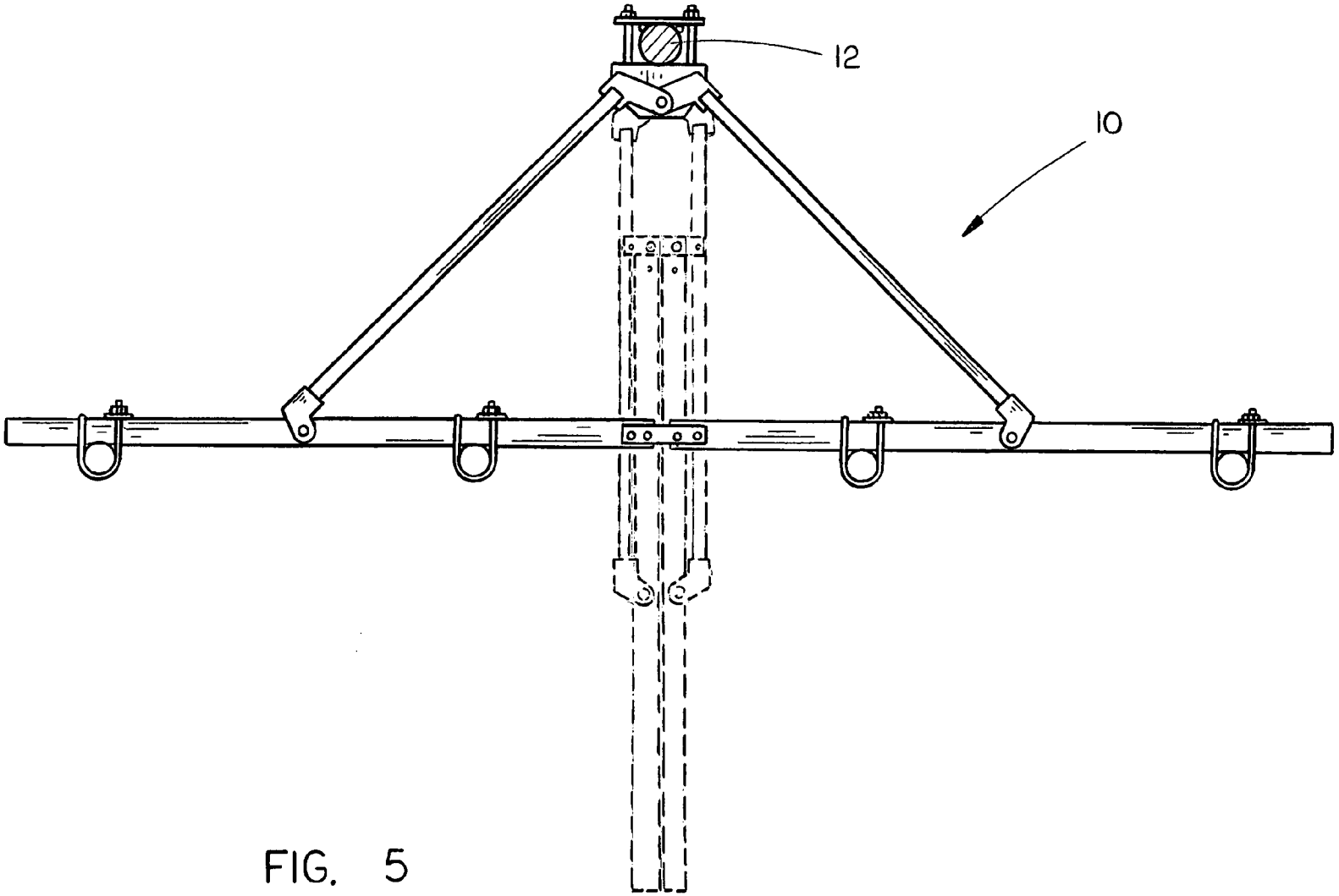
FIG. 5 is a top view of the folding frame of FIG. 1 with the broken lines illustrating the folding frame in its folded condition.

The numerals 62, 64, 66 and 68 refer to elongated support members in the form of tubes, pipes, or other types of structure. It is preferred that the support members 62, 64, 66 and 68 be in the form of round or cylindrical pipes to provide a low wind-load standard. The inner ends of support members 62 and 64 are pivotally secured together by means of bolts 70 and 72 extending through opposing plates 74 and 76 (FIG. 3). The inner ends of support members 62 and 64 may be rigidly secured together by means of the bolts 70' and 72' extending through plates 74 and 76, as seen in FIG. 1. The inner ends of support members 66 and 68 are pivotally secured together by means of bolts 78 and 80 extending through opposing plates 82 and 84 (FIG. 3). The inner ends of support members 66 and 68 may be rigidly secured together by means of the bolts 78' and 80' extending through plates 82 and 84, as seen in FIG. 1.

Support member 62 is pivotally secured, intermediate its length, to the angled plate 40 on the outer end of support arm 30 by means of bolt 86. Support member 64 is pivotally secured, intermediate its length, to the angled plate 44 on the outer end of support arm 32 by means of bolt 88. Support member 66 is pivotally secured, intermediate its length, to angled plate 50 at the outer end of support arm 34 by means of bolt 90. Support member 68 is pivotally secured to angled plate 54 on the outer end of support arm 36 by means of bolt 92. Elongated antenna supports 94 and 96 are secured to and extend between support members 62 and 66, as seen in FIG. 1. Elongated antenna supports 98 and 100 are secured to and extend between the support members 64 and 66, as seen in FIG. 1. Although four antenna supports 94, 96, 98 and 100 are illustrated, two or three antenna supports may be utilized.

Figure 2:
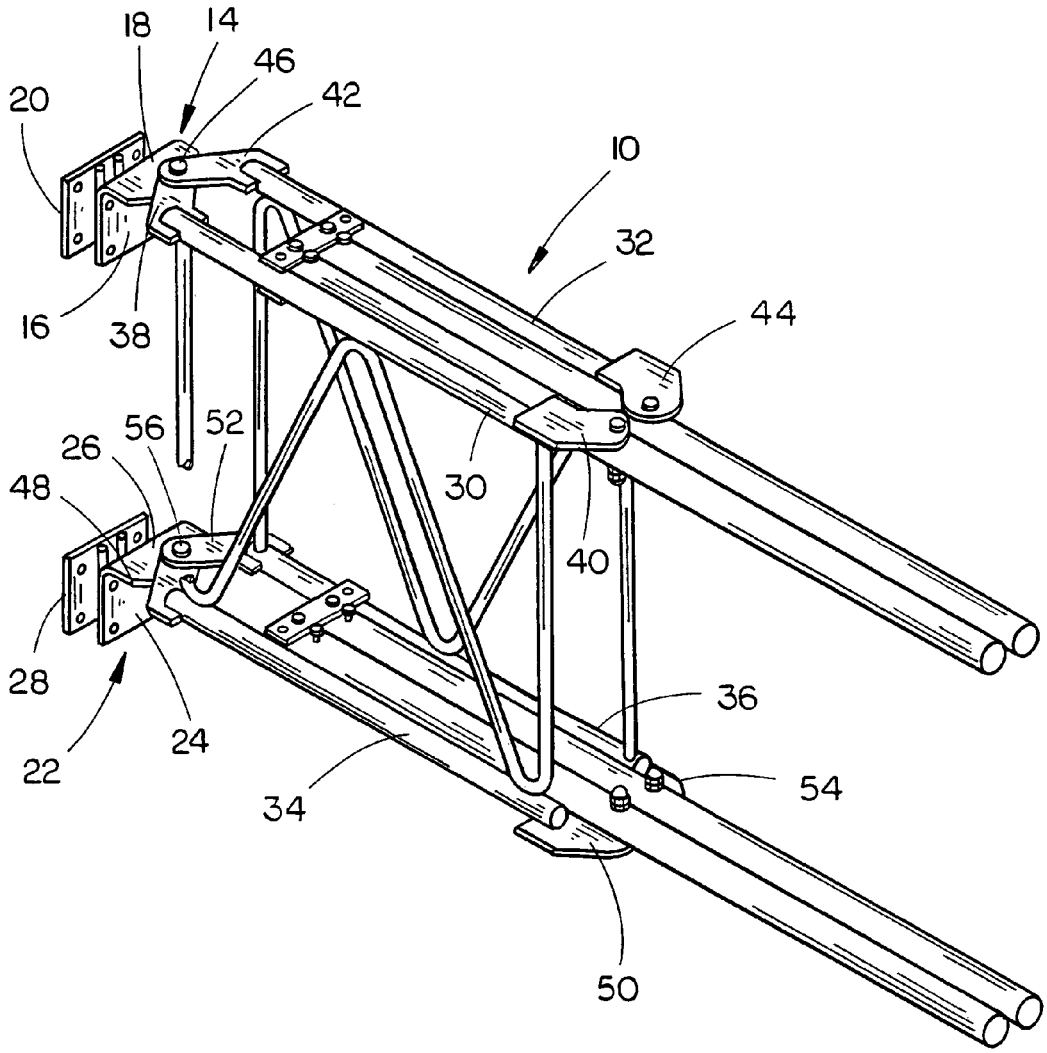
FIG. 2 is a perspective view of the folding frame in its folded condition.

The pivotal connection of the support arms 30, 32, 34 and 36 to the support members 62, 64, 66 and 68 and the pivotal connections at the inner ends of the support members 62, 64 and 66, 68 enables the frame 10 to be pivotally moved from a folded position, as seen in FIG. 2, to the operative or extended or non-folded position of FIG. 1. If the frame is assembled at the factory and shipped to the job site on a pallet or the like, the frame will be folded so that the inner ends of the support members 62, 64, 66 and 68 are positioned between the inner ends of the support arms 30, 32, 34 and 36, thereby occupying fairly little space (FIG. 2). When the folded frame 10 arrives at the job site for installation, the frame 10 is easily pivotally moved from its folded position to its operative position. If the antenna supports 94, 96, 98 and 100 were not mounted on the frame 10 prior to being shipped to the job site, the antenna supports will be mounted on the support members 62, 64, 66 and 68 at the job site.

Not only does the folding frame of this invention provide a very compact unit for shipment, but the V-shaped configuration of the support arms, and the connection of the plates 74, 76 and 82, 84 to the support members 62, 64 and 66, 68, when the frame is in its extended or operative position, adds strength and stability to the assembly. Further, the round or cylindrical shape of the support arms 30, 32, 34 and 36 and the support members 62, 64, 66 and 68 provides a low wind-load standard. Normally, one or more tie back arms will be extended from the support members to the support structure 12.

Thus it can be seen that the invention accomplishes at least all of its stated objectives.

I claim:

1. A folding frame for mounting an antenna on an upstanding support structure, comprising:

an upper mounting bracket for attachment to the support structure;

a lower mounting bracket for attachment to the support structure below said upper mounting bracket;

first, second, third and fourth elongated support arms, each having inner and outer ends;

said inner ends of said first and second support arms being pivotally secured to said upper mounting bracket about a generally vertical axis and extending outwardly therefrom;

said inner ends of said third and fourth support arms being pivotally secured to said lower mounting bracket about a generally vertical axis and extending outwardly therefrom;

first second, third and fourth elongated support members having first and second ends;

said first support member being selectively pivotally secured, intermediate its length, to said outer end of said first support arm about a generally vertical axis so that said first support member is generally horizontally disposed;

said second support member being selectively pivotally secured, intermediate its length, to said outer end of said second support arm about a generally vertical axis so that said second support member is generally horizontally disposed;

said third support member being selectively pivotally secured, intermediate its length, to said outer end of said third support arm about a generally vertical axis so that said third support member is generally horizontally disposed;

said fourth support member being selectively pivotally secured, intermediate its length, to said outer end of said fourth support arm about a generally vertical axis so that said fourth support member is generally horizontally disposed;

said second ends of said first and second support members being selectively pivotally secured together about a general vertical axis so that said first and second support members may be selectively moved between a first folded position to a second extended position;

said second ends of said third and fourth support members being selectively pivotally secured together about a general vertical axis so that said third and fourth support members may be selectively moved between a first folded position to a second extended position;

at least one upstanding antenna support secured to and extending between said first and third support members;

and at least one upstanding antenna support secured to and extending between said second and fourth support members.

2. The folding frame of claim 1 wherein a first brace is secured to said first and third support arms and extends therebetween and wherein a second brace is secured to said second and fourth support arms and extends therebetween.

3. The folding frame of claim 1 wherein a pair of antenna supports are secured to said first and third support arms and wherein a pair of antenna supports are secured to said second and fourth support members.

4. The folding frame of claim 1 wherein said second ends of said first, second, third and fourth support members are positioned inwardly of said outer ends of said first, second, third and fourth support arms when said first, second, third and fourth support members are in their folded position.

5. The folding frame of claim 1 wherein said first, second, third and fourth support members comprise pipes.

6. The folding frame of claim 1 wherein said antenna supports comprise pipes.

7. The folding frame of claim 1 wherein said inner ends of said first and second support arms have angled plates secured thereto which are pivotally secured to said upper mounting bracket and wherein said inner ends of said third and fourth support members have angled plates secured thereto which are pivotally secured to said lower mounting bracket.

8. The folding frame of claim 1 wherein said outer ends of said first and second support arms have angled plates secured thereto which are pivotally secured to said first and second support members, respectively, and wherein said outer ends of said third and fourth support arms have angled plates secured thereto which are pivotally secured to said third and fourth support members, respectively.

9. The folding frame of claim 7 wherein said outer ends of said first and second support arms have angled plates secured thereto which are pivotally secured to said first and second support members, respectively, and wherein said outer ends of said third and fourth support arms have angled plates secured thereto which are pivotally secured to said third and fourth support members, respectively.

10. The folding frame of claim 1 further including structure which maintains said support members in their said second extended position.

11. The folding frame of claim 10 wherein said structure which maintains said support members in their said second extended position comprises first and second elongated opposing plates secured to and extending between said second ends of said first and second support members and third and fourth elongated opposing plates secured to and extending between said second ends of said third and fourth support members, a first pair of bolts extending through one end of said first and second plates and said second end of said first support member, a second pair of bolts extending through the other end of said first and second plates and said second end of said second support member, a third pair of bolts extending through one end of said third and fourth plates and said second end of said third support member, and a fourth pair of bolts extending through the other end of said third and fourth plates and said second end of said fourth support member.

12. The folding frame of claim 1 wherein said support arms comprise pipes.

13. A folding frame for mounting an antenna on an upstanding support structure, comprising:

an upper mounting bracket for attachment to the support structure;

a lower mounting bracket for attachment to the support structure below said upper mounting bracket;

first, second, third and fourth elongated support arms, each having inner and outer ends;

said inner ends of said first and second support arms being pivotally secured to said upper mounting bracket about a generally vertical axis and extending outwardly therefrom;

said inner ends of said third and fourth support arms being pivotally secured to said lower mounting bracket about a generally vertical axis and extending outwardly therefrom;

first, second, third and fourth elongated support members having first and second ends;

said first support member being selectively pivotally secured, intermediate its length, to said outer end of said first support arm about a generally vertical axis so that said first support member is generally horizontally disposed;

said second support member being selectively pivotally secured, intermediate its length, to said outer end of said second support arm about a generally vertical axis so that said second support member is generally horizontally disposed;

said third support member being selectively pivotally secured, intermediate its length, to said outer end of said third support arm about a generally vertical axis so that said third support member is generally horizontally disposed;

said fourth support member being selectively pivotally secured, intermediate its length, to said outer end of said fourth support arm about a generally vertical axis so that said fourth support member is generally horizontally disposed;

said first and second support members being selectively pivotally movable with respect to said first and second support arms, respectively, so that said first and second support members may be selectively moved between a first folded position to a second extended position with respect to said first and second support arms, respectively;

said third and fourth support members being selectively pivotally movable with respect to said third and fourth support arms, respectively, so that said third and fourth support members may be selectively moved between a first folded position to a second extended position with respect to said third and fourth arms, respectively;

at least one upstanding antenna support secured to and extending between said first and third support members;

and at least one upstanding antenna support secured to and extending between said second and fourth support members;

said second ends of said first and second support members being selectively secured together to maintain said first and second support members in said second extended position;

said second ends of said third and fourth support members being selectively secured together to maintain said third and fourth support members in said second extended position.

14. The folding frame of claim 13 wherein a pair of antenna supports are secured to said first and third support arms and wherein a pair of antenna supports are secured to said second and fourth support members.

15. The folding frame of claim 13 wherein said second ends of said first, second, third and fourth support members are positioned inwardly of said outer ends of said first, second, third and fourth support arms when said first, second, third and fourth support members are in their folded position.

16. The folding frame of claim 13 wherein said inner ends of said first and second support arms have angled plates secured thereto which are pivotally secured to said upper mounting bracket and wherein said inner ends of said third and fourth support members have angled plates secured thereto which are pivotally secured to said lower mounting bracket.

17. The folding frame of claim 13 wherein said outer ends of said first and second support arms have angled plates secured thereto which are pivotally secured to said first and second support members, respectively, and wherein said outer ends of said third and fourth support arms have angled plates secured thereto which are pivotally secured to said third and fourth support members, respectively.

18. The folding frame of claim 16 wherein said outer ends of said first and second support arms have angled plates secured thereto which are pivotally secured to said first and second support members, respectively, and wherein said outer ends of said third and fourth support arms have angled plates secured thereto which are pivotally secured to said third and fourth support members, respectively.

19. The folding frame of claim 13 further including structure which maintains said support members in their said second extended position.

20. The folding frame of claim 19 wherein said structure which maintains said support members in their said second extended position comprises first and second elongated opposing plates secured to and extending between said second ends of said first and second support members and third and fourth elongated opposing plates secured to and extending between said second ends of said third and fourth support members, a first pair of bolts extending through one end of said first and second plates and said second end of said first support member, a second pair of bolts extending through the other end of said first and second plates and said second end of said second support member, a third pair of bolts extending through one end of said third and fourth plates and said second end of said third support member, and a fourth pair of bolts extending through the other end of said third and fourth plates and said second end of said fourth support member.

* * * * *